US006508622B1

(12) United States Patent
Neumeier

(10) Patent No.: US 6,508,622 B1
(45) Date of Patent: Jan. 21, 2003

(54) AXIAL FAN WITH REVERSIBLE FLOW DIRECTION

(75) Inventor: Ralf Neumeier, Zweibrücken (DE)

(73) Assignee: Turbo Lufttechnik GmbH, Zweibrucken (DE)

( * ) Notice: Subject to any disclaimer, the term of this patent is extended or adjusted under 35 U.S.C. 154(b) by 0 days.

(21) Appl. No.: 09/837,593

(22) Filed: Apr. 18, 2001

(30) Foreign Application Priority Data

Jun. 21, 2000 (DE) ..... 100 30 497

(51) Int. Cl.[7] ..... F04D 29/56
(52) U.S. Cl. ..... 415/149.3; 415/160
(58) Field of Search ..... 415/149.3, 149.4, 415/159, 160, 910

(56) References Cited

U.S. PATENT DOCUMENTS 3,820,916 A * 6/1974 Agushev et al ..... 415/152
3,946,554 A * 3/1976 Neumann ..... 60/204
3,946,556 A * 3/1976 Neumann ..... 60/204

* cited by examiner

*Primary Examiner*—Edward K. Look
*Assistant Examiner*—Dwayne J. White
(74) *Attorney, Agent, or Firm*—Thomas S. Baker, Jr.

(57) ABSTRACT

An axial fan with reversible flow direction comprises a rotor (11), which is driven by a variable speed-controlled driving motor (14) and is provided with adjustable rotor blades (13) fitted around a rotational axis. The rotor (11) is preceded by an inlet stator (15) and followed by a downstream stator (16), which are each provided with guide vanes (17, 18). The guide vanes (17, 18) of the inlet stator (15) and the downstream stator (16) are designed so as to be mirror-symmetrical to the radial center plane of the rotor (11) and may be adjusted at an angle to the direction of flow in such a way that—when the flow direction is reversed—the inlet stator (15) takes on the function of a downstream stator and the downstream stator (16) takes on the function of an inlet stator.

32 Claims, 2 Drawing Sheets

AXIAL FAN WITH REVERSIBLE FLOW DIRECTION

Figure 1:
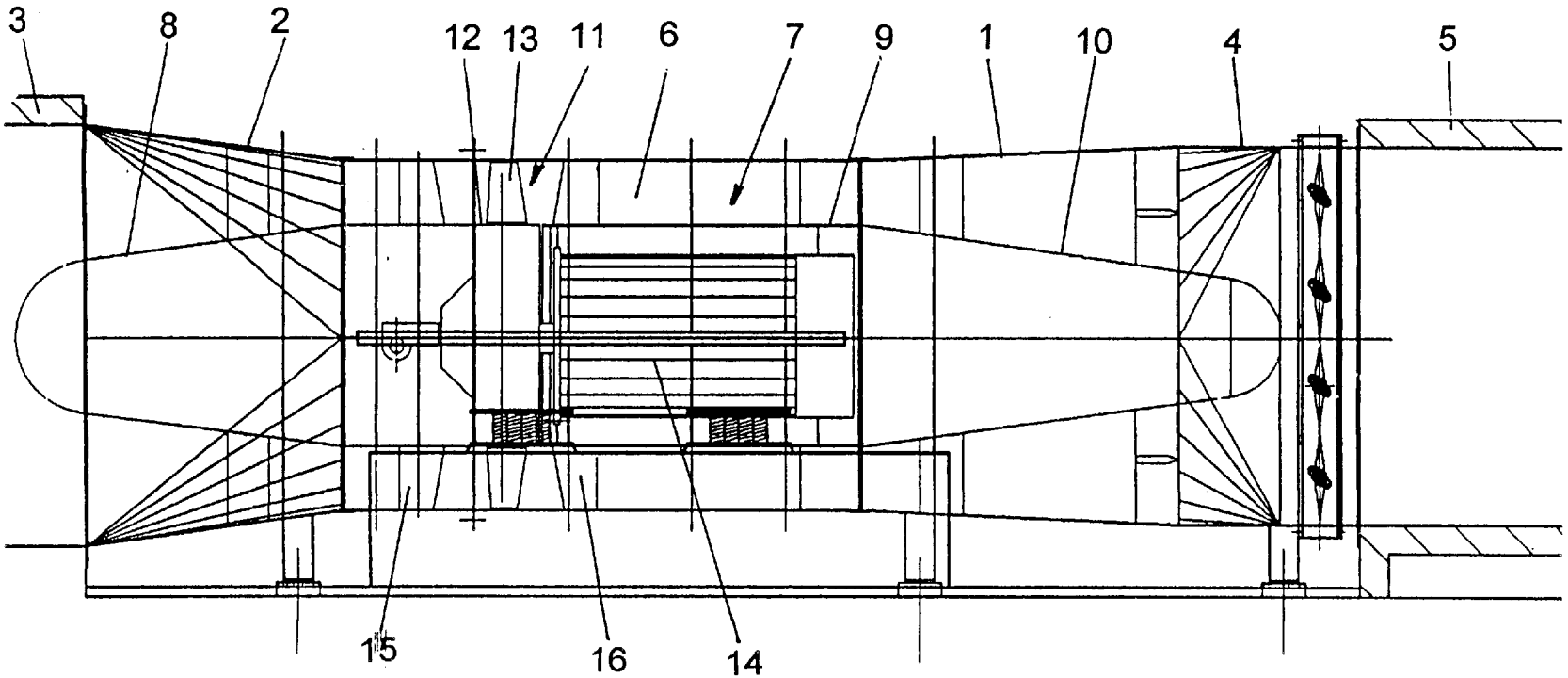

This invention relates to an axial fan with a reversible flow direction.

Modern axial fans are controllable, high-performance machines, which transform mechanical energy into airflow energy. Control options for these machines generally include functions for adjusting the speed of the rotor and changing the setting angle (pitch) of the rotor blade with the aim of adapting the steepness of the lifting force to the current speed and airflow rate.

A level of efficiency in a fan of 90 percent ensures that operating costs are kept to a minimum. However, in addition to design-based efficiency, another potentially important factor is the level of efficiency of the fan, when operating under off-design (part-load) conditions. The most efficient way of regulating the fan is by altering the speed of the rotor.

However, rotational speed control only makes sense, when all the operating points lie near the most energy-efficient system characteristic curve. In cases where these operating points deviate from the most energy-efficient system characteristic curve due to specific system factors (e.g. through the pressure admission of the system, parallel operation with other fans or other, similar factors), it is practical to make changes to both the speed and the pitch of the rotor blades in order to obtain high levels of efficiency for off-design (partial load) performance situations. For this purpose, the rotor blades of the rotor are designed as adjustable elements positioned around a rotational axis.

The rotor can also be combined with an additional subsequent rotor, which converts the kinetic energy of the existing rotating components into static pressure. Aerodynamic efficiency can be significantly improved through the use of a suitable downstream stator corresponding to the rotor. Inlet stators can also be installed in a fan. An inlet stator effects a change in the usable increase in pressure of the fan. The characteristic curve of the fan is raised or lowered depending on the angular momentum generated in front of the rotor (direction of swirl contrary to or equivalent to the rotational direction of the rotor).

When an axial fan of this type is used for an application such as tunnel ventilation, one of the tasks of the fan may involve effecting a change of direction of the airflow, even if this function is only required on an occasional basis. This would apply to fire situations where conflagration gases are to be conveyed against the standard operating direction of flow in order to reach a closer tunnel exit. For the purpose of achieving this change in the direction of airflow, a method is known, whereby the rotating blades of the rotor are turned to a degree, which enables the desired change of flow direction to be effected. This, however, inevitably means that the effectiveness, which can be achieved using this operating format, is drastically reduced, since any downstream stator, which may be present, will now act as an incorrectly positioned "inlet stator", as soon as the flow direction has been changed, and will thereby significantly interfere with the conditions of the airflow to the rotor. Values for aerodynamic performance as well as for energy consumption in relation to the quantity of air conveyed will then be markedly inferior to those achieved under normal operating conditions. Attempts have previously been made to avoid this loss of quality by mechanically rotating the whole fan by 180° around an axis perpendicular to the rotational axis of the rotor, whenever a change in the direction of flow is required. This is, however, only really practical for relatively small axial fans.

A possible solution involving thrust reversal (as used in aircraft engines) is rejected on the basis that energy efficient operation is not possible with axial fans in this context. Additionally, this method only involves reverse-flow operations of short duration, whereas the change of direction required in axial fans must be effected for longer periods under the most energy-efficient conditions.

The purpose of this invention is the design of an axial fan with reversible flow direction, according to the type described above, which enables the same aerodynamic performance (in terms of high pressure figures and a high level of efficiency during operation) to be achieved in both directions, with a predetermined volume flow rate.

This objective—per the intent of this invention—is accomplished for an axial fan of the type described above through the characteristic specifications contained in claim 1. Preferable embodiments of the invention form the object of the subclaims.

The use of an inlet stator and a downstream stator, combined with the design and adjustability of the guide vanes of these stators, allows the inlet stator to function as a downstream stator and the downstream stator to function as an inlet stator, when the direction of flow is reversed. These guide vanes may be adjusted in the same way as the rotor blades of the rotor, meaning that they can be moved into an optimal position based on the current requirements. Once the airflow has been reversed by adjusting the turning direction of the rotor and/or the blades, it is possible to operate the axial fan in both directions of flow in such a way that the same amount of energy is required for equivalent air movements in both directions of flow and that this energy requirement approximates the energy consumption of those axial fans designed to operate in only one direction without any reversal functionality.

The particular type of application anticipated for the axial fan according to the invention necessitates the use of an adjustable downstream stator. For this reason, an adjustable inlet stator is added to the rotor of this axial fan, which is capable of taking on the function of a downstream stator in the event of an airflow reversal without requiring that the inlet rotor have the capacity to alter the increase in pressure.

An example embodiment of the invention is shown in the drawing and is described in more detail below. The drawing comprises:

FIG. 1 showing the longitudinal section of a fan arrangement and

Figure 2:
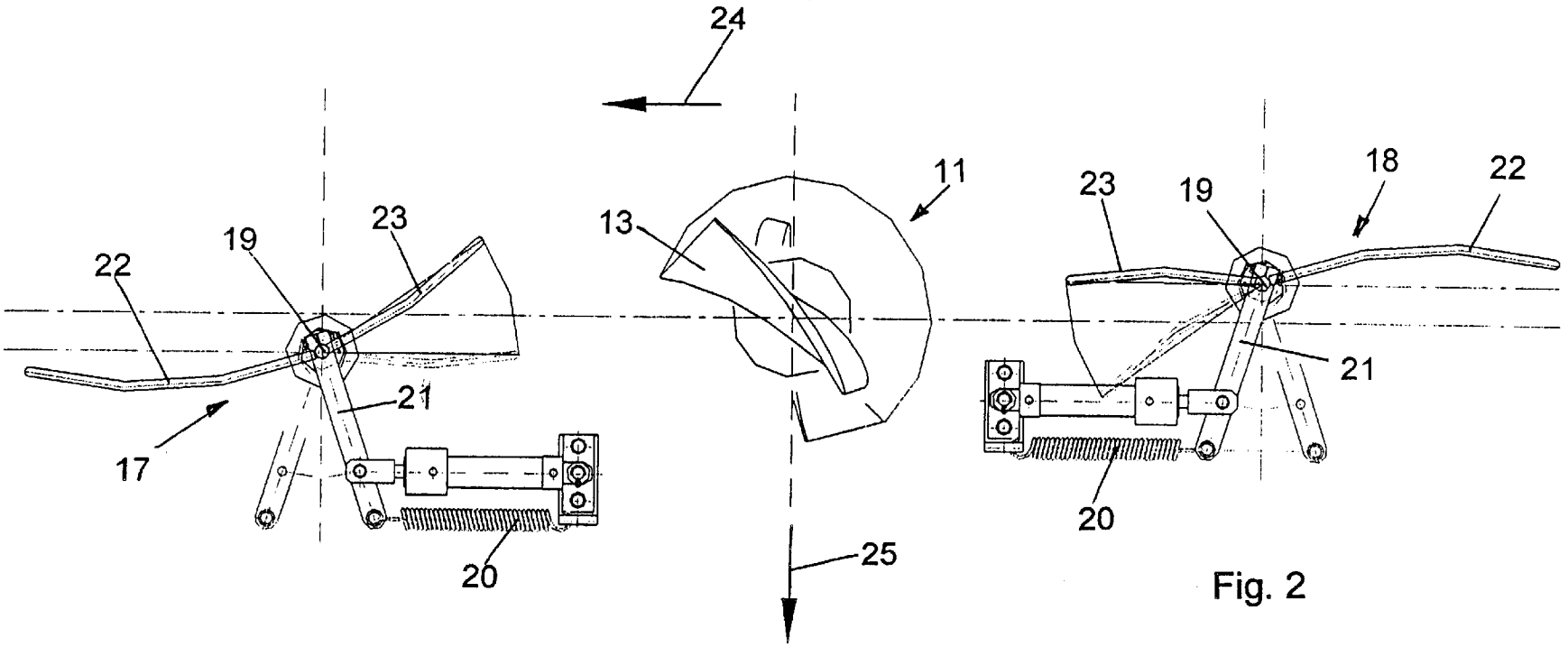

FIG. 2 showing the plan view of a rotor and two stators.

The fan arrangement consists of fan casing 1, which, on one side, is connected with inlet box 3 via air inlet fitting 2 and, on the other side, is connected with outlet box 5 via outlet fitting 4. Inside fan casing 1, an axial fan is positioned at a distance from the wall of the casing resulting in the formation of flow channel 6.

The axial fan contains hub 7 with streamlined inflow component 8, cylindrical central component 9 and streamlined outflow component 10. Rotor 11 is positioned within cylindrical central component 9 of hub 7. Rotor 11 consists of rotor hub 12, which is in alignment with cylindrical central component 9 of hub 7.

Rotor 11 is fitted with rotor blades 13 around its circumference. Rotor blades 13 may be twisted around a rotational axis, which proceeds radially from rotor 11. Rotor blades 13 are adjusted during operation or during a stop period by means of a mechanical, electric or hydraulic activating drive.

As shown in FIG. 2, rotor blades 13 are positioned mirror-symmetrically in relation to the rotational axis. The activating drive allows rotor blades 13 to be twisted to a sufficient extent to ensure that optimum levels of efficiency can be achieved—corresponding to the family of characteristics for all flow levels and operating conditions.

Due to the mirror-symmetrical design, rotor blades 13 can also be twisted so as to effect a change in the direction of flow. In such an event, air inlet fitting 2 becomes an outlet fitting and air outlet fitting 4 becomes an air inlet fitting. This kind of reversal of flow direction is useful, for example, when employing the axial fan for purposes of tunnel ventilation, in a case where conflagration gases resulting from a fire are to be conveyed to a closer airshaft or tunnel exit.

Rotor 11 is driven by driving motor 14, which is positioned within hub 7 as a fitted motor. Driving motor 14 is designed as an asynchronous motor and is provided with a variable speed control system. This speed control system also serves as a method for achieving an optimum level of efficiency under differing operating conditions. The direction of rotation of the asynchronous motor can be reversed by means of a single changeover switch. Reversal of the asynchronous motor also changes the direction of rotation of rotor 11. This, together with adjustment of rotor blades 13, thus represents another method of effecting a reversal of the direction of flow.

Inside fan casing 1, rotor 11 is preceded by fixed-position inlet stator 15 and fixed-position downstream stator 16. Stators 15 and 16 are provided with guide vanes 17 and 18, which are preferably curved. This curvature may be achieved by producing guide vanes 17 and 18 from straight sections connected to each other at obtuse angles. Guide vanes 17 of inlet stator 15 are designed so as to be mirror-symmetrical to guide vanes 18 of downstream stator 16, in which context the radial center plane of rotor 11 forms the plane of symmetry.

Guide vanes 17 and 18 of inlet stator 15 and downstream stator 16 are arranged in such a way that they can be twisted around rotational axis 19. This arrangement allows them to be adjusted at an angle to the direction of flow. Adjustment of guide vanes 17 and 18 is effected mechanically or electrically by means of adjusting lever 21—which acts upon rotational axis 19—against the spring resistance of recuperating spring 20. Adjusting lever 21 is positioned on fan casing 1. The purpose of adjusting guide vanes 17 and 18, as well as twisting rotor blades 13, is to obtain an optimum level of efficiency.

In a special embodiment of the invention, guide vanes 17 and 18 consist of fixed-position section 22 and adjustable section 23. The parting plane of sections 22 and 23 of guide vanes 17 and 18 lies on the plane of guide vanes 17 and 18 along rotational axis 19. Adjustable sections 23 of guide vanes 17 and 18 are each turned towards rotor 11.

With the position of rotor blades 13 depicted in FIG. 2, the axial fan generates an air current in the direction of flow indicated by arrow 24 with a direction of rotation according to arrow 25. In this case, guide vanes 17 and 18 of inlet stator 15 and downstream stator 16 take up the position indicated by the unbroken lines. If the direction of flow is reversed by a changeover of the asynchronous motor and the corresponding twisting of rotor blades 13, the guide vanes are adjusted so as to take up the position shown in FIG. 2 by the dashed lines. In this case, inlet stator 15 takes on the function of a downstream stator and downstream stator 16 takes on the function of an inlet stator. Optimal operation of the axial fan may be achieved in both directions of flow through the corresponding adjustment of guide vanes 17 and 18.

What is claimed is:

1. Axial fan with reversible flow direction comprising a rotor (11), driven by a variable speed-controlled driving motor (14) and provided with adjustable rotor blades (13) fitted around a rotational axis, characterized in that the rotor (11) is preceded by an inlet stator (15) and followed by a downstream stator (16), which are both provided with guide vanes (17, 18), that the guide vanes (17, 18) of the inlet stator (15) and the downstream stator (16) are designed so as to be mirror-symmetrical to the radial center plane of the rotor (11), and that the guide vanes (17, 18) may be adjusted at an angle to the direction of flow in such a way that—when the direction of flow is reversed—the inlet stator (15) takes on the function of a downstream stator and the downstream stator (16) takes on the function of an inlet stator.

2. Axial fan according to claim 1, characterized in that the driving motor (14) of the rotor (11) is an asynchronous motor with a reversible direction of rotation.

3. Axial fan according to claim 1, characterized in that the rotor blades (13) of the rotor (11) are positioned mirror-symmetrically to their axis of rotation and may be adjusted at a rotational angle, which allows optimum operating conditions and/or a reversal of flow direction to be achieved.

4. Axial fan according to claim 3, characterized in that the driving motor (14) of the rotor (11) is an asynchronous motor with a reversible direction of rotation.

5. Axial fan according to claim 1, characterized in that the guide vanes (17, 18) of the inlet stator (15) and the downstream stator (16) may be adjusted at an angle which allows optimum operating conditions to be achieved for both directions of flow.

6. Axial fan according to claim 5, characterized in that the driving motor (14) of the rotor (11) is an asynchronous motor with a reversible direction of rotation.

7. Axial fan according to claim 5, characterized in that the rotor blades (13) of the rotor (11) are positioned mirror-symmetrically to their axis of rotation and may be adjusted at a rotational angle, which allows optimum operating conditions and/or a reversal of flow direction to be achieved.

8. Axial fan according to claim 7, characterized in that the driving motor (14) of the rotor (11) is an asynchronous motor with a reversible direction of rotation.

9. Axial fan according to claim 1, characterized in that the guide vanes (17, 18) of the inlet stator (15) and the downstream stator (16) each have a rotational axis (19) and each consist of a fixed-position section (22) and a section (23), which may be adjusted around the rotational axis (19), that this adjustable section (23) of the guide vanes (17, 18) faces the rotor (11), and that the rotational axis (19) is positioned on the guide vane plane along the parting line between the fixed-position and the adjustable sections (22, 23) of the guide vanes (17, 18).

10. Axial fan according to claim 9, characterized in that the driving motor (14) of the rotor (11) is an asynchronous motor with a reversible direction of rotation.

11. Axial fan according to claim 9, characterized in that the rotor blades (13) of the rotor (11) are positioned mirror-symmetrically to their axis of rotation and may be adjusted at a rotational angle, which allows optimum operating conditions and/or a reversal of flow direction to be achieved.

12. Axial fan according to claim 11, characterized in that the driving motor (14) of the rotor (11) is an asynchronous motor with a reversible direction of rotation.

13. Axial fan according to claim 9, characterized in that the guide vanes (17, 18) of the inlet stator (15) and the downstream stator (16) may be adjusted at an angle which allows optimum operating conditions to be achieved for both directions of flow.

14. Axial fan according to claim 13, characterized in that the driving motor (14) of the rotor (11) is an asynchronous motor with a reversible direction of rotation.

15. Axial fan according to claim 13, characterized in that the rotor blades (13) of the rotor (11) are positioned mirror-symmetrically to their axis of rotation and may be adjusted at a rotational angle, which allows optimum operating conditions and/or a reversal of flow direction to be achieved.

16. Axial fan according to claim 1, characterized in that the guide vanes (17, 18) of the inlet stator (15) and the downstream stator (16) are curved.

17. Axial fan according to claim 16, characterized in that the driving motor (14) of the rotor (11) is an asynchronous motor with a reversible direction of rotation.

18. Axial fan according to claim 16, characterized in that the rotor blades (13) of the rotor (11) are positioned mirror-symmetrically to their axis of rotation and may be adjusted at a rotational angle, which allows optimum operating conditions and/or a reversal of flow direction to be achieved.

19. Axial fan according to claim 18, characterized in that the driving motor (14) of the rotor (11) is an asynchronous motor with a reversible direction of rotation.

20. Axial fan according to claim 16, characterized in that the guide vanes (17, 18) of the inlet stator (15) and the downstream stator (16) may be adjusted at an angle which allows optimum operating conditions to be achieved for both directions of flow.

21. Axial fan according to claim 20, characterized in that the driving motor (14) of the rotor (11) is an asynchronous motor with a reversible direction of rotation.

22. Axial fan according to claim 20, characterized in that the rotor blades (13) of the rotor (11) are positioned mirror-symmetrically to their axis of rotation and may be adjusted at a rotational angle, which allows optimum operating conditions and/or a reversal of flow direction to be achieved.

23. Axial fan according to claim 22, characterized in that the driving motor (14) of the rotor (11) is an asynchronous motor with a reversible direction of rotation.

24. Axial fan according to claim 16, characterized in that the guide vanes (17, 18) of the inlet stator (15) and the downstream stator (16) each have a rotational axis (19) and each consist of a fixed-position section (22) and a section (23), which may be adjusted around the rotational axis (19), that this adjustable section (23) of the guide vanes (17, 18) faces the rotor (11), and that the rotational axis (19) is positioned on the guide vane plane along the parting line between the fixed-position and the adjustable sections (22, 23) of the guide vanes (17, 18).

25. Axial fan according to claim 24, characterized in that the driving motor (14) of the rotor (11) in an asynchronous motor with a reversible direction of rotation.

26. Axial fan according to claim 24, characterized in that the rotor blades (13) of the rotor (11) are positioned mirror-symmetrically to their axis of rotation and may be adjusted at a rotational angle, which allows optimum operating conditions and/or a reversal of flow direction to be achieved.

27. Axial fan according to claim 26, characterized in that the driving motor (14) of the rotor (11) is an asynchronous motor with a reversible direction of rotation.

28. Axial fan according to claim 24, characterized in that the guide vanes (17, 18) of the inlet stator (15) and the downstream stator (16) may be adjusted at an angle which allows optimum operating conditions to be achieved for both directions of flow.

29. Axial fan according to claim 28, characterized in that the driving motor (14) of the rotor (11) is an asynchronous motor with a reversible direction of rotation.

30. Axial fan according to claim 28, characterized in that the rotor blades (13) of the rotor (11) are positioned mirror-symmetrically to their axis of rotation and may be adjusted at a rotational angle, which allows optimum operating conditions and/or a reversal of flow direction to be achieved.

31. Axial fan according to claim 30, characterized in that the driving motor (14) of the rotor (11) is an asynchronous motor with a reversible direction of rotation.

32. Axial fan according to claim 15, characterized in that the driving motor (14) of the rotor (11) is an asynchronous motor with a reversible direction of rotation.

* * * * *